US007140488B1

(12) United States Patent
Lordahl et al.

(10) Patent No.: US 7,140,488 B1
(45) Date of Patent: Nov. 28, 2006

(54) UNIVERSAL PACKAGE FOR FLAPPER AND ACCESSORIES AND METHOD OF MAKING SAME

(75) Inventors: Var Lordahl, 1571 Schaeffer Rd., Long Grove, IL (US) 60047; Scott H. Koepsel, Winthrop Harbor, IL (US)

(73) Assignee: Var Lordahl, Long Grove, IL (US)

( * ) Notice: Subject to any disclaimer, the term of this patent is extended or adjusted under 35 U.S.C. 154(b) by 381 days.

(21) Appl. No.: 10/699,322

(22) Filed: Oct. 31, 2003

(51) Int. Cl.
*B65D 51/00* (2006.01)

(52) U.S. Cl. ..... 206/4.29; 206/4.28

(58) Field of Classification Search ..... 206/736, 206/751, 756, 45.2, 45.21, 45.25, 45.28, 206/45.29; 229/102.5, 103, 904
See application file for complete search history.

(56) References Cited

U.S. PATENT DOCUMENTS 1,116,043 A * 11/1914 Elliott ..... 229/125.37
1,369,924 A * 3/1921 Horr ..... 206/45.21
2,695,097 A * 11/1954 Easton ..... 206/45.21
4,572,423 A * 2/1986 Spencer ..... 206/562
5,038,930 A * 8/1991 Holtkamp, Jr. ..... 206/232
5,420,775 A * 5/1995 Kusmer ..... 362/376
5,497,876 A * 3/1996 Fleming ..... 206/232
6,070,719 A * 6/2000 Pollock ..... 206/232
6,868,964 B1 * 3/2005 Carty et al. ..... 206/232

* cited by examiner

*Primary Examiner*—Jila M. Mohandesi
(74) *Attorney, Agent, or Firm*—Kajane McManus

(57) ABSTRACT

The universal package for a flapper and accessories comprises a box foldable from a prescored blank and the blank from which the box is formed. Within this box isolating structures are provided to cushion and position the content, the isolating structures being variable in configuration to accommodate virtually any embodiment of flapper and any accessory therefor. The box is provided with a cover section which engages in an elevated manner over the contents to hold same in place and the package also includes viewing ports to ascertain the package content.

1 Claim, 3 Drawing Sheets

UNIVERSAL PACKAGE FOR FLAPPER AND ACCESSORIES AND METHOD OF MAKING SAME

BACKGROUND OF THE INVENTION

1. Field of the Invention

The present invention relates to a universal package for a flapper and accessories in the form of a box which includes structure to protect the contents from damage, as well as including ported areas for viewing of the content thereof, the blank from which the package is formed and the method of making same.

2. Prior Art

Heretofore flappers have been packaged in plastic, which is a very expensive project. The packaging has also been time consuming because of the great number of embodiments for flappers available.

The package, the blank for same, and method of the present invention decrease cost, labor, and cost for packaging, the package being configured to accommodate substantially all available flapper embodiments.

SUMMARY OF THE INVENTION

According to the invention there is provided a universal package for a flapper and accessories comprising a box foldable from a prescored blank. Within this box isolating structures are provided to cushion and position the content, the isolating structures being variable in configuration to accommodate virtually any embodiment of flapper and any accessory therefor. The box is provided with a cover section which engages over the contents to hold same in place and the package also includes viewing ports to ascertain the package content.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
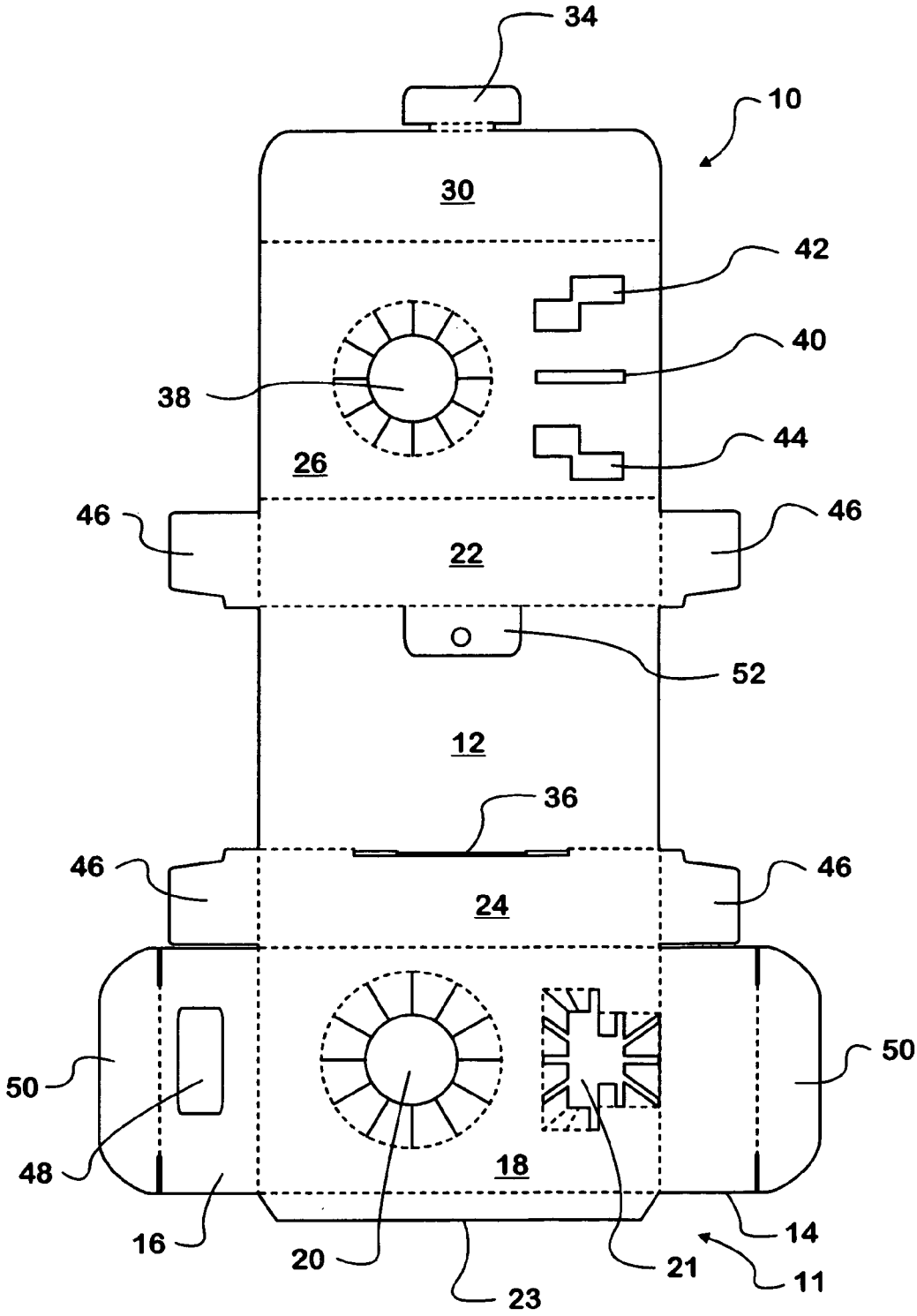
FIG. 1 is a plan view of a blank from which the package of FIGS. 2–5 is formed.

Referring now to the drawings in greater detail, there is illustrated in FIGS. 1–5 a universal package for a flapper and accessories 10 made in accordance with the teachings of the present invention.

Figure 3:
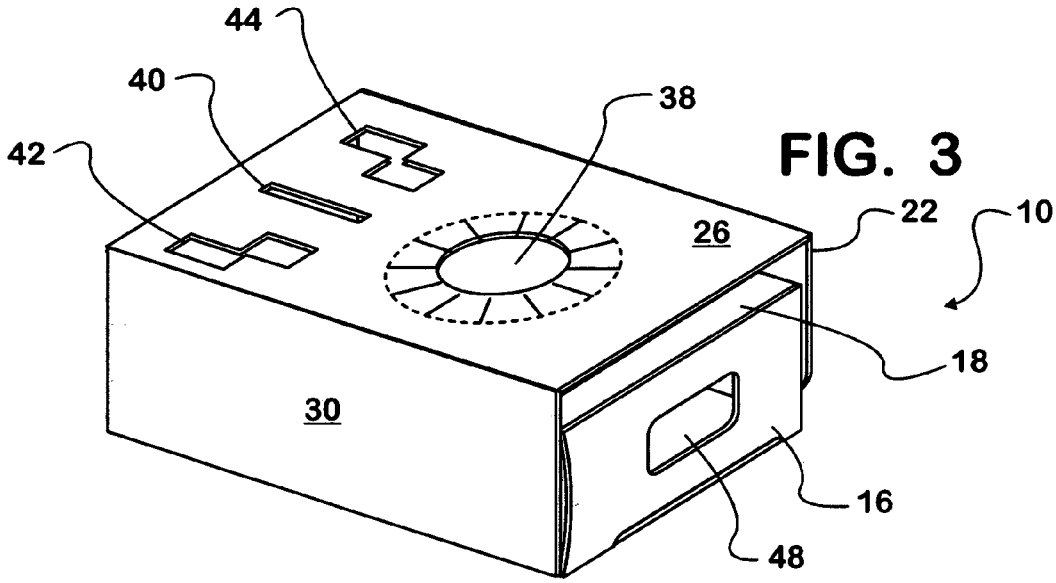
FIG. 3 is another perspective view of the package of FIG. 2.
Figure 2:
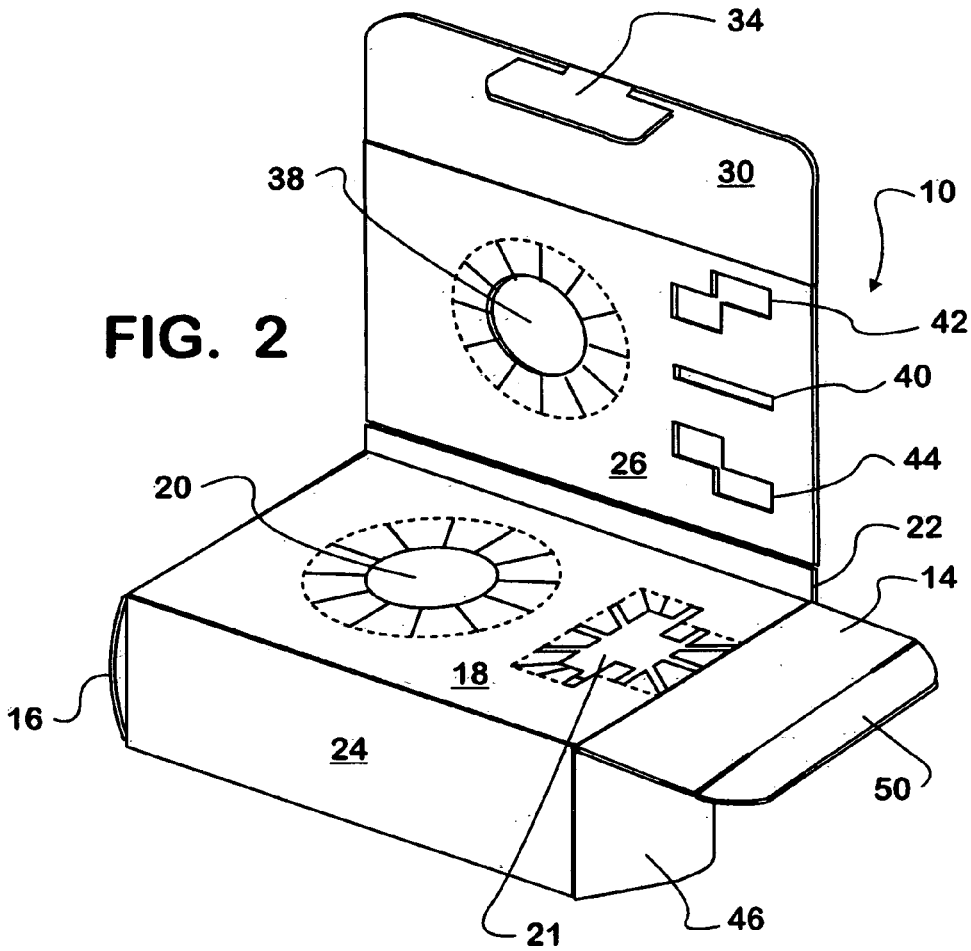
FIG. 2 is a perspective view of a package of the present invention.
Figure 5:
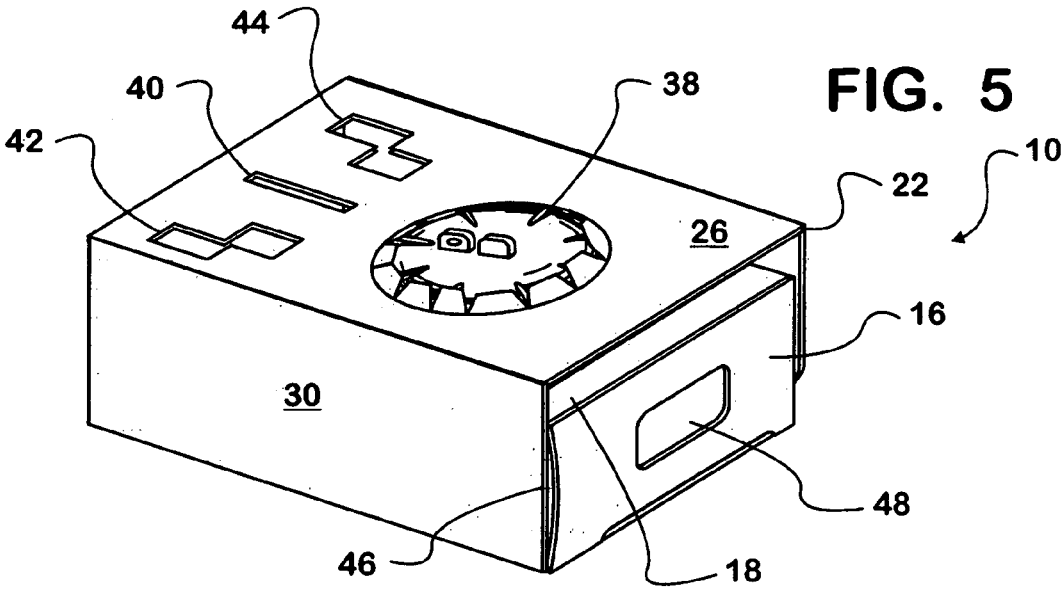
FIG. 5 is a perspective view showing the package with the flapper securely received therein.
Figure 4:
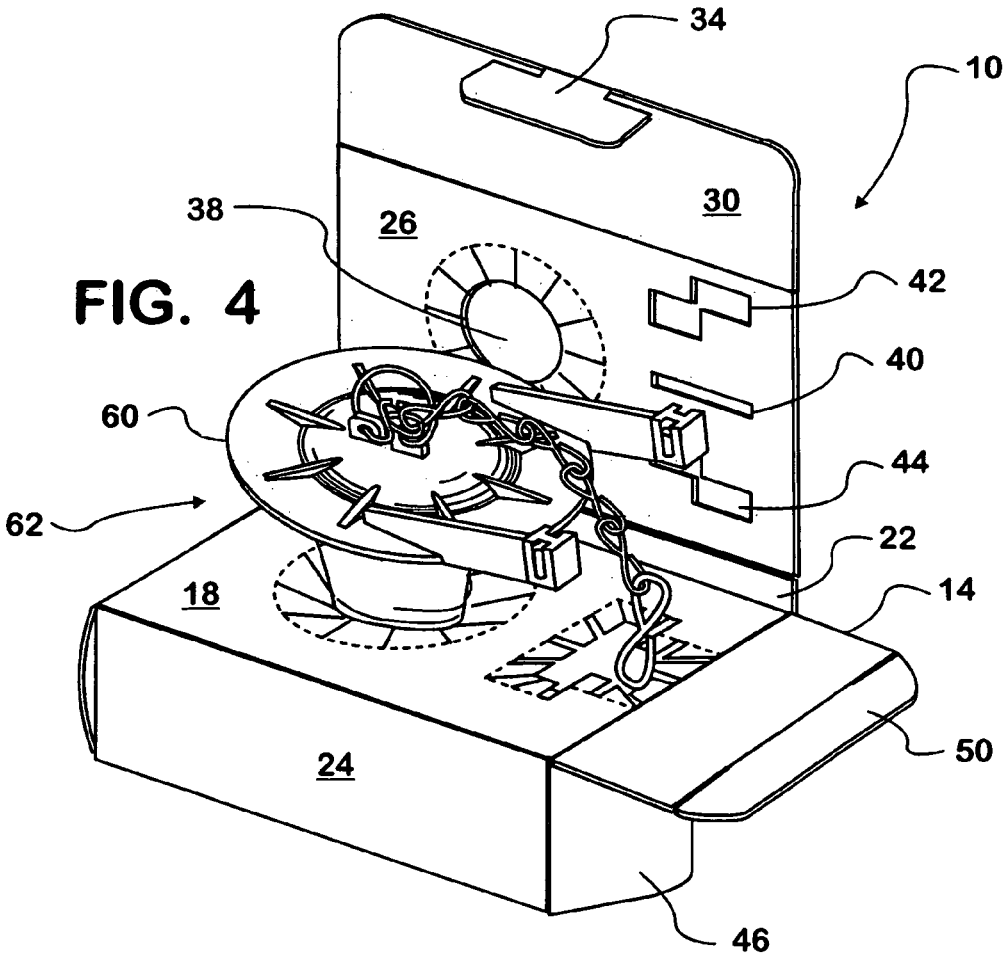
FIG. 4 is a perspective view showing an exemplary embodiment of a flapper being inserted into the package and an exemplary accessory in phantom positioned within the package.

FIGS. 3 and 5 show the package 10 in its constructed, closed form, while FIGS. 2 and 4 show the package 10 in the process of being folded from a blank 11 therefor shown in FIG. 1.

As shown, the package 10 is configured to be a box 10 which includes a bottom panel 12, opposed first and second side panels 14 and 16 extending a predetermined distance from a top panel 18 including at least two openings 20 and 21 therein, a two piece rear panel comprising portions 22 and 23, a front panel 24, and a cover panel 26 which is engaged to the rear panel portion 22, When the package 10 is formed, the cover panel 26 is positioned over the top panel 18 and includes an end flap 30 which is positioned over front panel 24 with a tab 34 extending from the end flap 30 engageable within a corresponding slit 36 provided for same at the junction of the front panel 24 with the bottom panel 12.

Also, although the package 10 here is shown to accommodate a single exemplary embodiment of a flapper 40, this is not to be construed as limiting.

The cover panel 26 includes a first opening 38 therein which is substantially similar to the opening 20 in the top panel 18, and overlies same when the cover panel 26 is in a closed position.

Further, a plurality of slits 40, 42 and 44 are also provided in the cover panel 26 which overlie the opening 21 in the top panel 18 when the cover 26 is in the closed position.

The front and rear panels 24 and 22 respectively each have opposed end tabs 46 thereon, which tuck between the top panel 18 and bottom panel 12 when the package 10 is being formed. These tabs 46, particularly on the side of the package 10 incorporating side panel 16 must be short enough not to obstruct viewing through a viewing port 48 provided in the side panel 16.

Each side panel 14, 16 has an end panel or tab 50 which secures the side panels 14 in a closed position by coacting with the tabs 46, which are positioned interior thereto when the package 10 is formed.

It is also proposed to provide the bottom panel 12 with a hanger cutout 52 which is used for displaying the package 10 on a rack (not shown).

In forming the package 10, it will be understood first of all that rear panel portion 22 and end flap 30 of cover panel 26 are of a height greater than that of front panel 24 allowing for a spacing between the cover panel 26 and top panel 18 for accommodation of a body or base 60 of a flapper 62 therebetween, as well as any accessories, as necessary.

Thus, one must first fold rear panel portion 22 upwardly against the rear panel portion 23 after the end panels 14 and 16 are positioned to form the package 10 with the top panel 18 being substantially parallel to bottom panel 12 so that the position at which rear panel portion 23 must be secured to rear panel portion 22 is known to allow for the desired spacing between the top panel 18 and the cover panel 26.

Once portions 22 and 23 are secured at the appropriate position by any suitable means, such as by gluing, the cover panel is folded over the top panel 26 and the end flap 30 is folded over the front panel 24 with the tab 34 thereon being received in slit 36 between the bottom and front panels 12 and 24 respectively, forming the closed package 10.

Turning back now to the openings 20 and 21 and 38, 40, 42, and 44 in the top and cover panels 18 and 26, respectively, it will be understood that flappers 62 are available in a variety of embodiments.

To accommodate virtually all such existing embodiments, the openings 20, 21 and 38 are enlargeable. In this respect, each of these openings is surrounded by a radial array of cross cuts 50 such that flaps 52 are formed which can be manipulated by the flapper 62 as the seal 64 thereof is positioned within the opening 20 and the base 66 thereof is covered by the opening 38, so that the flapper 62 is accommodated by the package 10. Also, opening 21 in top surface 18 is similarly configured with crosscuts 50 forming flaps 52 so that any embodiment of accessory 20 required for a particular embodiment of a flapper 6, such as a chain 70 or a float 70 shown in phantom in FIG. 4, can also be accommodated, making the package 10 substantially universal.

The window 48 provided in side panel 16 is now useful in viewing the configuration of the seal 64 of the flapper 62, once seated within the box 10 and below the opening 20 in the top surface 18 thereof.

Further, the configuration of the base 66 of the flapper 62 can be seen in the space 70 provided between the top and cover panels 18 and 26 respectively by creating an elevated rear panel portion 22 and end flap 30 on cover panel 26 relative to front panel 24.

Finally for the openings 40, 42 and 44 are provided in the cover panel 26 allowing viewing of any accessories when present.

As described above, the universal flapper package 10 and method of making same of the present invention has a number of advantages, some of which have been described above and other of which are inherent in the invention.

Also, modifications may be proposed without departing from the teachings herein. Accordingly, the scope of the invention is only to be limited as necessitated by the accompanying claims.

The invention claimed is:

1. In combination with a flapper, a universal package for the flapper comprising:

a box including at least a rectangular bottom panel having two ends and two sides, a front panel extending from one side of the bottom panel and having end flaps thereon, a top panel extending from another side of the front panel, the top panel having a plurality of ports thereon, a first portion of a rear panel extending from said top panel, the top panel having an side panel at each end thereof and each side panel incorporating an end tab, one side panel having a port therein, a second rear panel portion, of a height greater than the front panel, extending from an opposite side of the bottom panel, the second rear panel having end tabs identical in height to the end tabs on the front panel, a cover panel extending from the second rear panel portion and incorporating a front cover panel of a height equal to the height of the second rear panel section and an end tab thereon which is received in a slit provided at a juncture of said front panel and said bottom panel.

* * * * *